US006263709B1

(12) United States Patent
Kemery et al.

(10) Patent No.: US 6,263,709 B1
(45) Date of Patent: Jul. 24, 2001

(54) SNOWBOARD LOCKING SYSTEM

(76) Inventors: Mike Kemery, 405 S. 19th Ave., Apt. C, Bozeman, MT (US) 59715; Eric Kapfhammer, 510-4th Ave. West, Apt. #1, Seattle, WA (US) 98119

( * ) Notice: Subject to any disclaimer, the term of this patent is extended or adjusted under 35 U.S.C. 154(b) by 0 days.

(21) Appl. No.: 09/517,638

(22) Filed: Mar. 3, 2000

Related U.S. Application Data

(60) Provisional application No. 60/123,292, filed on Mar. 4, 1999.

(51) Int. Cl.[7] ..... E05B 73/00
(52) U.S. Cl. ..... 70/14; 70/18; 70/19; 70/58
(58) Field of Search ..... 70/14, 18, 19, 70/57, 58

(56) References Cited

U.S. PATENT DOCUMENTS

| | | | | |
|---|---|---|---|---|
| 596,237 | * | 12/1897 | Damon | 70/18 |
| 3,754,420 | | 8/1973 | Oellerich | 70/58 |
| 3,905,214 | | 9/1975 | Bell | 70/58 |
| 3,962,893 | * | 6/1976 | Anderson | 70/19 |
| 3,999,409 | | 12/1976 | Bell | 70/58 |
| 3,999,410 | | 12/1976 | Hall | 70/58 |
| 4,057,983 | * | 11/1977 | Morgan | 70/18 |
| 4,216,665 | | 8/1980 | McKelvey | 70/58 |
| 4,598,561 | | 7/1986 | Girard | 70/58 |
| 4,768,359 | * | 9/1988 | Wade | 70/14 |
| 4,896,519 | | 1/1990 | Pitts | 70/58 |
| 5,419,165 | * | 5/1995 | Perkins | 70/14 |
| 5,582,044 | * | 12/1996 | Bolich | 70/58 |
| 5,675,999 | | 10/1997 | Carlstrom | 70/58 |
| 5,706,680 | * | 1/1998 | Wroble | 70/58 X |
| 5,887,460 | * | 3/1999 | Williams | 70/18 |
| 5,892,887 | * | 9/1998 | Béland | 70/14 |
| 5,901,586 | * | 5/1999 | Hale | 70/19 X |
| 5,904,056 | * | 5/1999 | Ozaki | 70/18 |
| 6,012,739 | * | 1/2000 | Weiss et al. | 70/18 X |
| 6,082,154 | * | 7/2000 | MacDonald | 70/18 |

FOREIGN PATENT DOCUMENTS

| | | | | |
|---|---|---|---|---|
| 228146 | * | 5/1925 | (GB) | 70/18 |

* cited by examiner

*Primary Examiner*—Lloyd A. Gall
(74) *Attorney, Agent, or Firm*—Dean A. Craine

(57) ABSTRACT

A snowboard locking system including two longitudinal members that are transversely aligned and partially overlapping from opposite sides of the middle section of a snowboard. Each elongated member includes a U-shaped portion designed to capture the outer edge of the snowboard when the elongated member is transversely aligned thereover. Formed on the end of each elongated member opposite the U-shaped portion is a wide body portion with a plurality of holes formed thereon. During installation on a snowboard, the elongated members are transversely aligned on opposite sides of the snowboard so that the U-shaped portions capture the opposite outer edges of the snowboard and the body portions overlap. A plurality of holes formed on the body portion of each elongated member may be aligned and registered. A lock extending through the aligned holes of the two elongated members is then used to hold them in a transversely aligned position on the snowboard. An optional cable is also provided that permanently attaches to the distal ends of each elongated member. During use, the cable may be looped around a fixed, stationary object to attach the snowboard to the object.

6 Claims, 3 Drawing Sheets

SNOWBOARD LOCKING SYSTEM

This is a utility patent application based on a provisional patent application (Ser. No. 60/123,292) filed on Mar. 4, 1999.

BACKGROUND OF THE INVENTION

1. Field of the Invention

This invention relates to locking systems, and, more specifically, to portable locking systems for snowboards.

2. Description of the Related Art

Snowboards are growing in popularity. With this growth, the number of snowboard thefts is also increasing.

Because snowboarding is a relatively new sport, racks with locks designed to temporarily hold a snowboard while the user goes inside the ski lodge are not widely available. Therefore, portable locking systems for snowboards would be very useful.

Ideally, the locking system for a snowboard should be lightweight and compact so that it can be transported by the user while snowboarding. The system should also be easily and quickly attachable to the snowboard to prevent use of the snowboard and to prevent or at least deter theft when left unattended. The system should be capable of being used with most snowboard designs without requiring modification to the snowboard itself.

SUMMARY OF THE INVENTION

It is an object of the present invention to provide a snowboard locking system.

It is another object of the present invention to provide a snowboard locking system that is lightweight and compact for portability by the snowboarder while snowboarding.

It is another object of the invention to provide such a snowboard locking system that prevents use of the snowboard when the system is activated.

It is a further object of the invention to provide such a snowboard locking system that can be used with all snowboard designs to prevent theft when left unattended and does not require modification to the snowboard itself.

These and other objects are met by a snowboard locking system that uses two rigid elongated members that, during use, are transversely aligned and extended across opposite sides of a snowboard and then locked in position around the snowboard. Each elongated member includes a U-shaped element having sufficient width to engage the outer edge of a snowboard, at least one first leg component having sufficient length to extend at least one-half way across a snowboard, and a second leg component parallel to the first leg component having sufficient length to engage the opposite side of the snowboard and prevent movement of the elongated member perpendicular to the top or bottom surfaces of the snowboard. During use, the ends of the first leg components are locked together to prevent the elongated members from sliding transversely apart and being removed from the snowboard.

In the first embodiment, a longitudinally aligned wide body portion is formed on the distal end of the first leg component on each elongated member. During installation, the elongated members are positioned on opposite sides of the snowboard so that the wide body portions overlap. A manual lock is then used to selectively lock the wide body portions together. In a second embodiment, a turn lock mechanism is provided on the distal ends of the first leg components, which enable them to slide transversely over the snowboard and lock together.

Formed on the inside edge of the U-shaped element is an optional diagonally aligned edge slot designed to engage the outer metal edge of the snowboard. Also provided is an optional cable connected at its opposite ends to the two elongated members. During use, the cable may be extended around a fixed, stationary object to hold the snowboard thereto.

During use, the elongated members are locked in position so that the outer edges of the snowboard are pressed against the inside edges of the U-shaped elements. The elongated members are also positioned approximately at the mid-line axis between the first and second bindings. In both embodiments, the first leg components must be placed over the top surface of the snowboard so that the bindings prevent the locked elongated members from sliding longitudinally over the ends of the snowboard. If the second leg components are sufficient length so that their distal ends are blocked by the bindings, the first leg components may be placed over the bottom surface of the snowboard. When used on an "hour glass shape" snowboard with wide toe and tail sections, longitudinal movement and removal of the locked elongated members is prevented.

DESCRIPTION OF THE PREFERRED EMBODIMENT(S)

Referring to the accompanying FIGS. 1–8, wherein like reference numbers denote like components, there is shown a lightweight, compact snowboard binding system 8. The system 8 is designed to be selectively attached to a snowboard 4 to prevent its operation if stolen. It is also designed to be selectively attached to a fixed object to prevent its removal therefrom.

Figure 4:
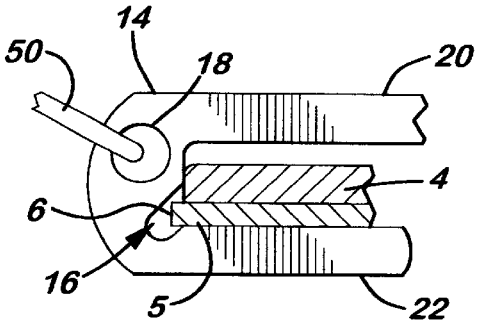
FIG. 4 is a partial, sectional, side elevational view of the diagonally aligned slot formed on the U-shaped portion receiving the outer edge of a snowboard.
Figure 5:
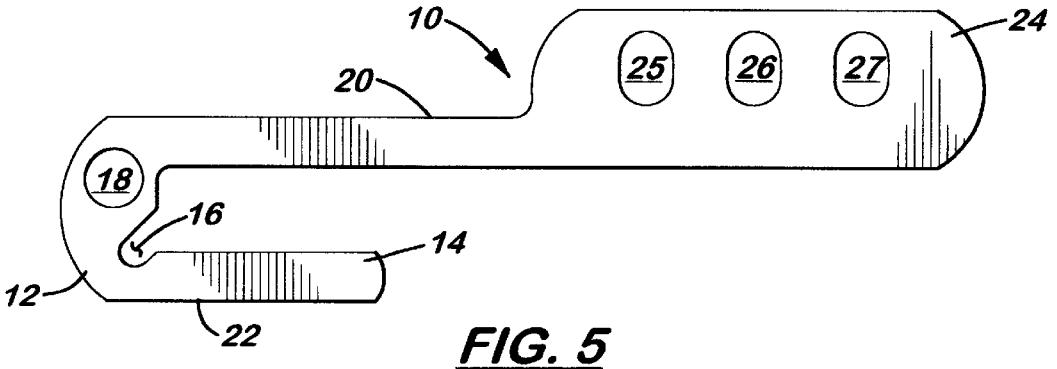
FIG. 5 is a top plan view of the elongated member.
Figure 6:
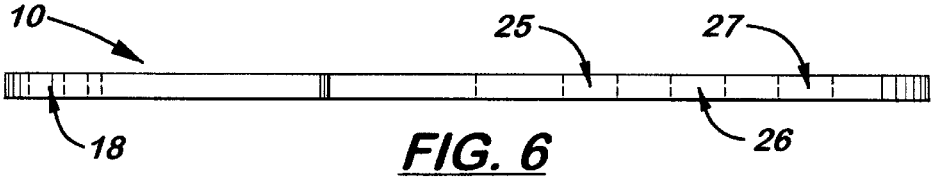
FIG. 6 is a side elevational view of the elongated member.

In the first embodiment, the system 8 includes two elongated members 10 that, during installation, are transversely aligned and extended across one surface from opposite sides of a snowboard 4. Each elongated member 10 is designed to extend transversely approximately ⅔ the width of a standard snowboard 4 at the mid-line axis of the snowboard 4. Each elongated member 10 includes a U-shaped element 14 with one parallel, integrally formed first leg component 20 and one second leg component 22. As shown in FIG. 4, the U-shaped element 14 is designed to receive the outer edge 5 of the snowboard 4 when the elongated member 10 is aligned transversely on the snowboard 4. Formed on the inside edge of the U-shaped element 14 is an optional diagonally aligned slot 16 designed to receive the outer metal strip 6 on the outer edge 5 of the snowboard 4.

Formed near the distal end of the first leg component 20 on each elongated member 10 is a wide body portion 24. In the preferred embodiment, the body portion 24 is aligned on the first leg component 20 so that the body portion 24 and U-shaped element 14 are parallel to each other. This alignment enables the body portion 24 to extend perpendicular to one side of the snowboard 4 when the outer edge 5 of the snowboard 4 is placed inside the U-shaped element 14. Also formed on the body portion 24 is a plurality of longitudinally aligned holes 25–27.

Figure 1:
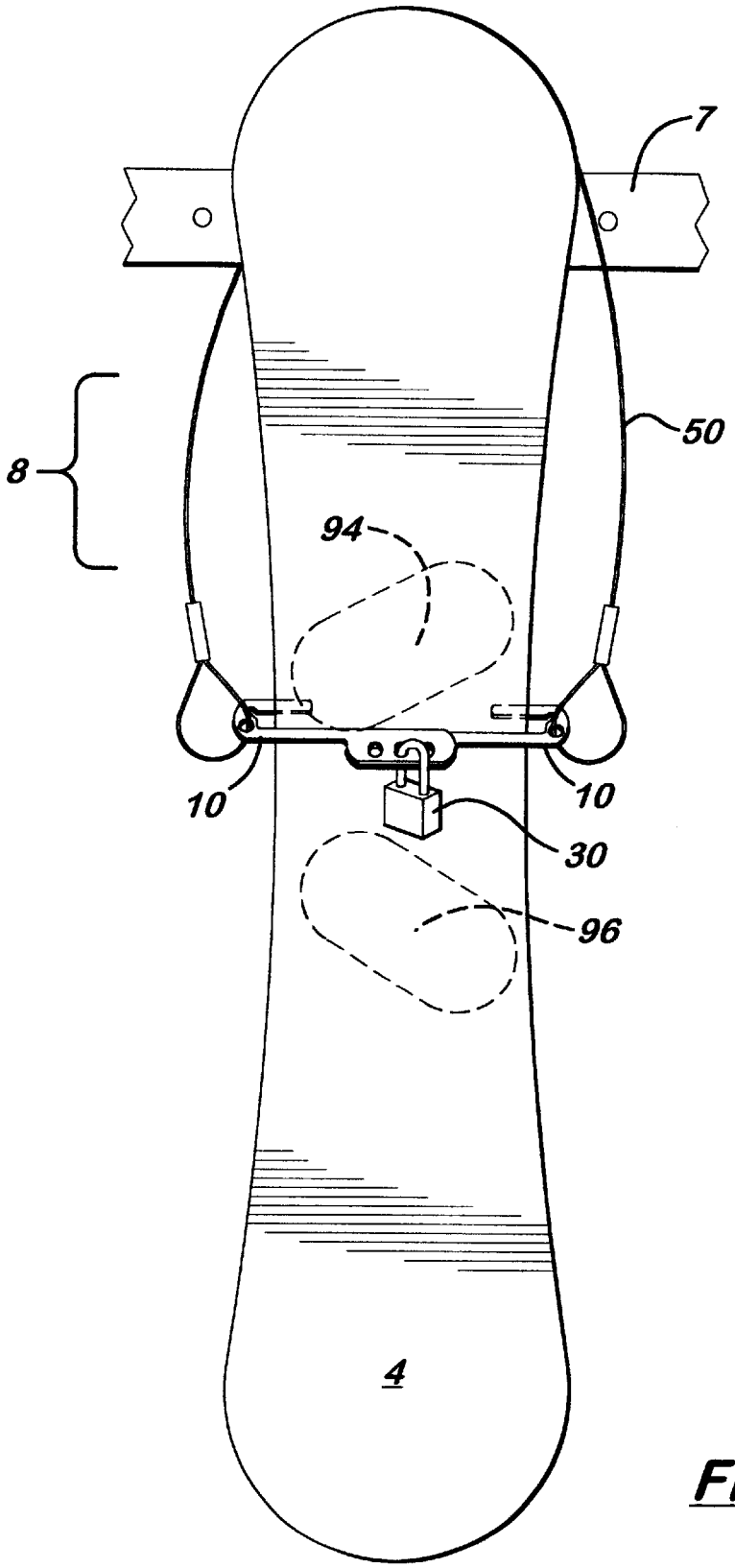
FIG. 1 is an illustration showing a snowboard attached to a vertical beam using the snowboard locking system disclosed herein.
Figure 2:
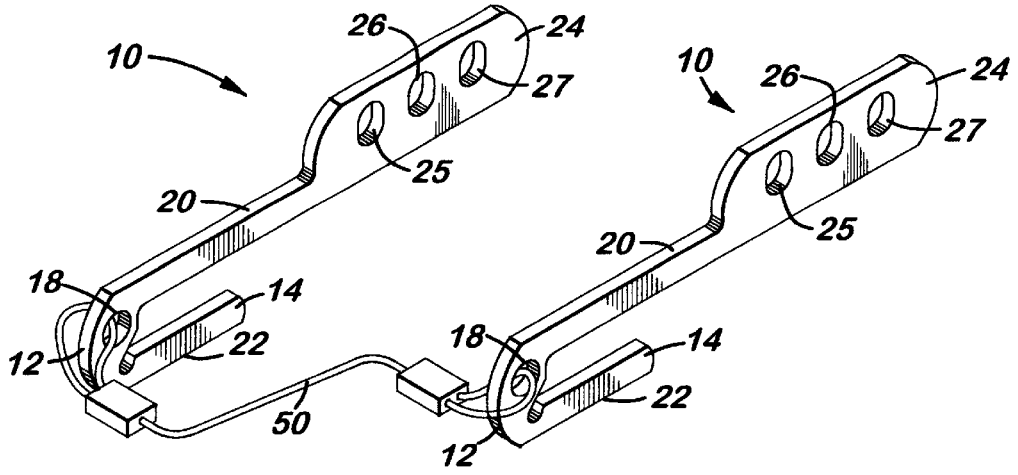
FIG. 2 is a perspective view of the two elongated members connected together at their opposite ends with a cable.
Figure 3:
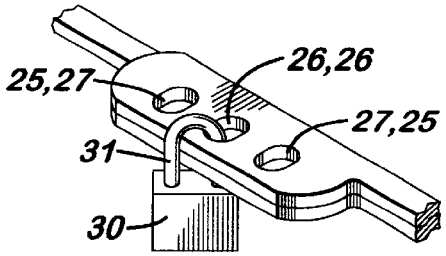
FIG. 3 is a partial perspective view of the two body portions overlapped and connected together with a lock.

During assembly, a pair of elongated members 10 is aligned transversely on the snowboard 4 directly across from each other as shown in FIG. 1. The elongated members 10 are forced inward so that the outer edges 5 of the snowboard 4 are placed against the inside edges of the U-shaped elements 14 as shown in FIG. 4. The body portions 24 overlap so that at least one of the holes 25–27 on each elongated member 10 are aligned and registered and capable of receiving a lock 30 to selectively lock the body portions 24 together.

In the first embodiment, the lock 30 includes a movable shackle 31, which is selectively inserted through any pair of corresponding aligned holes 25–27 on the two, overlapping elongated members 10. An optional cable 50 is securely attached at its opposite ends to holes 18 formed on the distal ends 12 of the elongated members 10 to permanently couple the elongated members 10 together. During use, the cable 50 may be wrapped around a fixed, stationary object 7 to attach the snowboard 4 thereto.

Each elongated member 10 is made of rigid steel plate material approximately 3/16 inch thick and 6½ inches in length. The U-shaped elements 14 are approximately ⅝ inch in width and approximately 2 inches in length. The holes 25–27 in the body portion 24 are oval and measure approximately ⅜ inch in diameter and ⅝ inch in length.

During use, the cable 50 is wrapped around a fixed, stationary object 7. The two elongated members 10 are then aligned transversely across the mid-line axis of the snowboard 4. Each elongated member 10 is positioned on the snowboard 4 so that the outer metal strip 6 on the edge 5 on the snowboard 4 is disposed into the diagonal slot 16 and at least one set of holes 25–27 on the two elongated members 10 is aligned and registered. The shackle 31 of the lock 30 is then inserted through a pair of aligned holes 25–27 to lock the elongated members 10 in a transversely aligned position on the snowboard 4.

Figure 7:
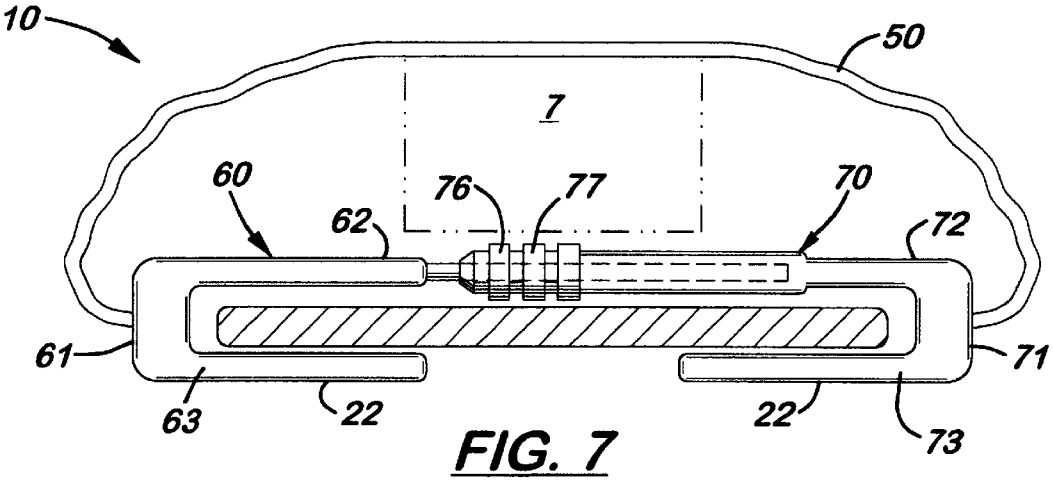
FIG. 7 is a side elevational view of a second embodiment of the invention.
Figure 8:
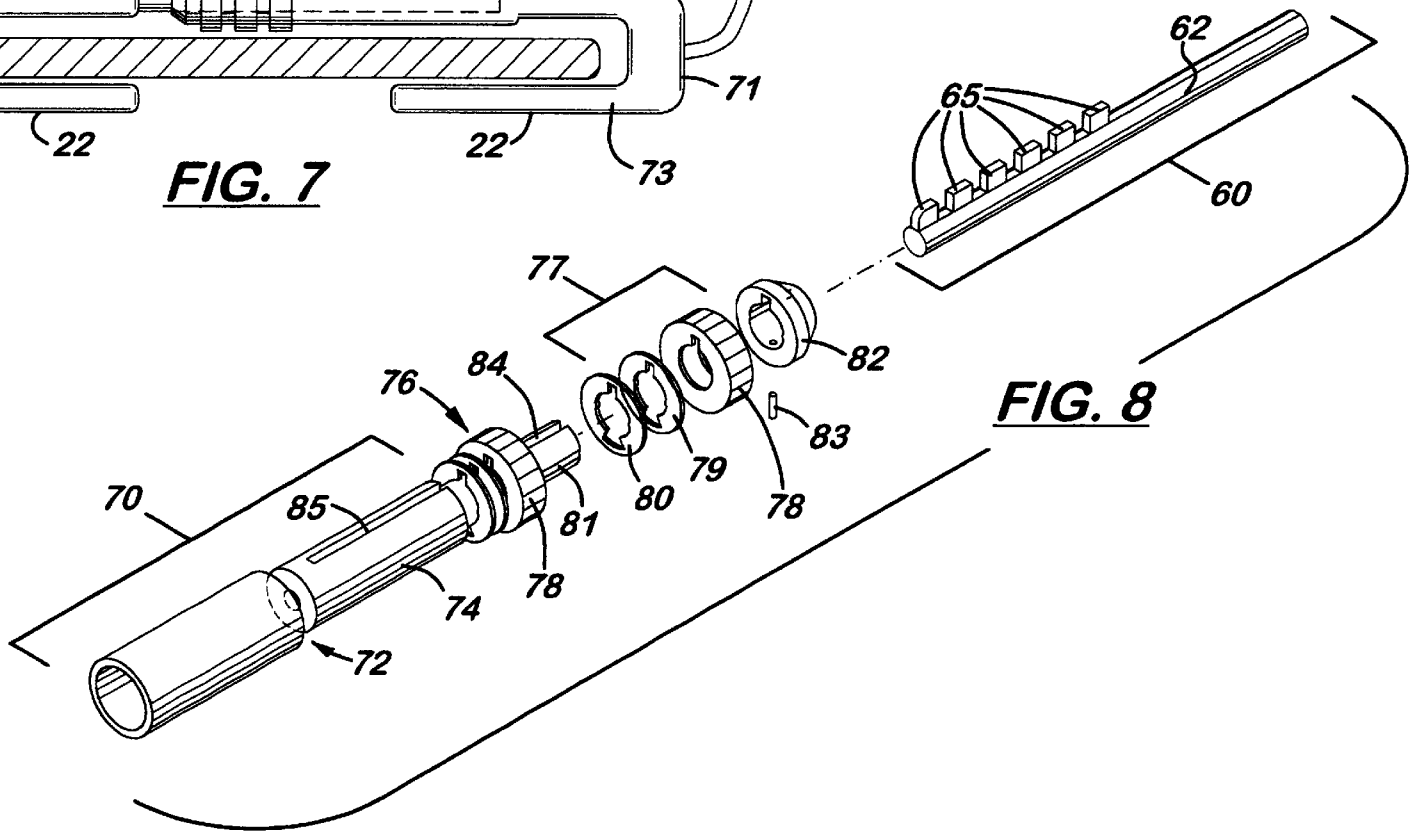
FIG. 8 is a perspective, partially exploded view of the locking mechanism used in the second embodiment of the invention.

In FIGS. 7 and 8, a second embodiment 10 of the invention is shown. The second embodiment comprises first and second elongated members 60, 70, each with U-shaped elements 61, 71, a long first leg component 62, 72 and a short second leg component 63, 73, respectively. In the second elongated member 70, a cylindrical-shaped body 74 is formed on the long leg component 72, which houses a sliding lock mechanism. Attached to the distal end of the body 74 are two turn locking sets 76, 77. Formed on the long leg component 62 of the first elongated member 60 is a plurality of spaced-apart teeth 65. During use, the distal end of the long leg component 62 is inserted into the central passageway 85 located in the cylindrical block 74 on the second elongated member 70.

As shown more clearly in FIG. 8, the sliding lock mechanism includes at least two lock sets 76, 77 disposed on the distal end of the long leg component 72. Each lock set 76, 77 includes a rotating thumb dial 78, a spring washer 79, and a flat spacer washer 80. During assembly, the lock sets 76, 77 slide longitudinally over a longitudinally aligned slotted member 81 integrally formed or attached to the long leg component 72. An end cap 82 is longitudinally aligned over the slotted member 81 to hold the lock sets 76, 77 therein. A retaining pin 83 is used to securely fasten the end cap to the distal end of the slotted member 81. Formed along one side of the slotted member 81 is a longitudinally aligned slot 84 that communicates with the central passageway 85 formed inside the long leg component 72. During use, the long leg component 62 is inserted into the central passageway 85. The thumb dials 78 on each lock set 76, 77 are turned to lock and unlock the first leg component 62 from the second leg component 72.

As shown in FIG. 7, a cable 50 is attached at its opposite ends to the first and second elongated members 60, 70 that may be placed around a fixed object such as a post 7 to attach a snowboard 4 to the post 7.

During installation, the elongated members are transversely aligned on opposite sides of the snowboard so that the outer edges of the snowboard are engaged by the U-shaped elements 14. If the system 8 is used on an "hour glass shaped" snowboard, then the first leg components 62, 72 may be placed over either the top surface or the bottom surface of the snowboard. If a "straight" shaped snowboard is used, then the first leg components 62, 72 must be placed over the top surface so that the snowboard bindings 94, 96 prevent the locked elongated members 10 from sliding over the ends of the snowboard 4. If the optional cable 50 is used, the cable 50 may be first wrapped around a fixed object 7 before the elongated members 10 are attached to the snowboard 4.

In compliance with the statute, the invention has been described herein in language more or less specific as to structural features. It should be understood, however, the invention is not limited to the specific features shown, since the means and construction shown comprise only the preferred embodiments for putting the invention into effect. For example, the length of the first and second leg components 62, 72 may vary and the type of locking means used to connect opposite leg components may vary. The invention is, therefore, claimed in any of its forms or modifications within the legitimate and valid scope of the amended claims, appropriately interpreted in accordance with the doctrine of equivalents.

We claim:

1. A snowboard locking system, comprising:

a. two elongated members, each said elongated member including a U-shaped element with two parallel first and second leg components, said U-shaped element having sufficient width to slidingly receive the outer perimeter edge of a snowboard and said first leg component being sufficient in length to extend at least partially across a snowboard when transversely aligned thereon;

b. a locking means capable of locking said first leg components on said elongated members together when said elongated members are transversely aligned over one surface and from opposite sides of a snowboard when said U-shaped elements are disposed around the opposite perimeter edges of said snowboard; and, c. a cable securely connected at its opposite ends to a different one of said elongated members such that a cable is generally adjacent both of the opposite perimeter edges when mounted thereon.

2. A snowboard locking system, as recited in claim 1, wherein said locking means includes a body portion with a plurality of holes formed on each said first leg component, said body portion on said first leg components capable of overlapping when said elongated members are transversely aligned on opposite sides of said snowboard, said locking means also including a lock with a shackle capable of being disposed in said holes to lock said body portions together.

3. A snowboard locking system, as recited in claim 1, further including a diagonal slot formed in said U-shaped element capable of engaging the lower outer edge on a snowboard.

4. A snowboard locking system, as recited in claim 1, wherein said locking means includes a turn dial locking mechanism attached to the distal end on one said elongated member and a set of teeth formed on the distal end of the opposite said elongated member, said turn dial locking mechanism and said teeth capable of being engaged to lock said opposite elongated members together.

5. A snowboard locking system, as recited in claim 4, further including a cable connected at its opposite ends to said elongated members.

6. A snowboard locking system, as recited in claim 4, further including a diagonal slot formed in said U-shaped element capable of engaging the lower outer edge on a snowboard.

* * * * *